US006923256B2

(12) United States Patent
Parker

(10) Patent No.: US 6,923,256 B2
(45) Date of Patent: Aug. 2, 2005

(54) DISCONNECT DEVICE

(75) Inventor: Robert Parker, Dorset (GB)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 10/693,911

(22) Filed: Oct. 28, 2003

(65) Prior Publication Data

US 2005/0087338 A1 Apr. 28, 2005

(51) Int. Cl.[7] ..... F21B 17/06
(52) U.S. Cl. ..... 166/242.7; 166/377; 285/3
(58) Field of Search ..... 166/242.6, 242.7, 166/377; 285/1–3

(56) References Cited

U.S. PATENT DOCUMENTS

| | | | | |
|---|---|---|---|---|
| 3,606,926 A | | 9/1971 | Schwegman | |
| 5,219,027 A | * | 6/1993 | Taylor | 166/377 |
| 5,526,888 A | * | 6/1996 | Gazewood | 175/320 |
| 5,718,291 A | * | 2/1998 | Lorgen et al. | 166/377 |
| 5,787,982 A | * | 8/1998 | Bakke | 166/242.6 |
| 5,960,884 A | | 10/1999 | Echols et al. | |
| 6,032,735 A | * | 3/2000 | Echols | 166/242.7 |
| 6,131,953 A | | 10/2000 | Connell et al. | |
| 6,213,206 B1 | * | 4/2001 | Bakke | 166/242.7 |
| 6,439,305 B1 | * | 8/2002 | Bakke | 166/242.6 |
| 6,629,563 B2 | * | 10/2003 | Doane | 166/125 |

FOREIGN PATENT DOCUMENTS

EP 0 624 709 A2 11/1994

* cited by examiner

*Primary Examiner*—Hoang Dang
(74) *Attorney, Agent, or Firm*—Finnegan, Henderson, Farabow, Garrett & Dunner LLP

(57) ABSTRACT

A disconnect device for use in oil well and gas well servicing operations. The device comprising a mandrel having one or more locking formations, and a hollow, female member in which the mandrel is releasably securable. The female member includes one or more lugs that are moveably retained relative to an inner surface thereof by a first retainer member engaged with at least one retainer formation formed in each lug. Each lug includes one or more locking formations. The disconnect device includes a second locking member that is moveable into and out of engagement with the retainer formation of each lug respectively to lock the lug in the first position and release it therefrom to permit its movement to the said second position.

11 Claims, 6 Drawing Sheets

DISCONNECT DEVICE

FIELD OF THE INVENTION

This invention relates to a disconnect device.

Disconnect devices are used in oil and gas drilling and other well servicing operations. Typically a disconnect device is used to connect a downhole tool to the remainder of a tubing string that may incorporate other components secured on the end of a length of coil tubing ("CT"). The purpose of the disconnect device is to provide a connection that remains robust at all times until it is required intentionally to disconnect the tool from the remainder of the tubing string. This may be when it is needed to cause retraction of the tubing string and CT above a stuck tool in a wellbore.

The advantages and applications of CT (as a means of conveying tooling to downhole locations; of providing actuating motions; and of circulating well fluids) are widely reported in the gas and oil field service arts, and for the most part will not be described in detail herein.

Nonetheless, one particular characteristic of CT is that it is hollow, thereby permitting the pumping of well fluids (eg. mud, and any of a range of chemical compositions) within a well to tooling supported at or near the downhole end of the tubing string.

It is also possible using CT to pump objects, such as actuator subs and so-called drop balls that are used to activate tools and other apparatus supported on the CT at a downhole location.

Tools can become stuck for example because of squeezing (ie. protrusion of extrudable strata, under pressure, from a surrounding formation into the wellbore); because of deviation of the wellbore; or simply because of partial collapse of the wellbore.

Under such circumstances the CT sometimes is not sufficiently robust to permit successful recovery of the stuck tool. Therefore it is necessary to withdraw the tubing string and CT, and deploy in the well a fishing tool that can latch onto the free end of the stuck tool, or a so-called "jar" that is capable of applying impulses to the stuck tool to free it.

These apparatus are typically conveyed to the downhole location on slickline.

DESCRIPTION OF THE PRIOR ART

GB-A-2 303 657 discloses a disconnect device that is suitable for use with CT.

The device of GB-A-2 303 657 includes a male member (herein "mandrel") that is received within a hollow female member in order to define two connector parts. The male member is retained within the female member by an elastically expandable ring that is captive within the female member.

The ring includes on an inner surface thereof a series of radially inwardly facing ridges that engage grooves on the exterior surface of the mandrel.

In the locked condition of the apparatus of GB-A-2 303 657, a safety sleeve encircles the elastically expandable ring, thereby retaining it in locking engagement over the end of the mandrel.

The safety sleeve is retained in its position encircling the expandable ring by one or more shear pins having a known shear threshold.

The safety sleeve is connected to a seat for a drop ball.

Operation of the disconnect of GB-A-2 303 657 occurs when a drop ball is pumped down the CT to engage the aforementioned seat. This blocks the flow of fluid through the disconnect device, with the result that the pumping pressure is applied (via the drop ball and seat) to the shear pins. These shear to permit movement of the safety sleeve. This then moves downwardly under the influence of the pumped fluid.

Such motion of the safety sleeve brings it out of engagement with the elastically expandable ring, which is then free to expand. Then it is possible to withdraw the mandrel upwardly from the end of the open, upper female member, leaving the female member and the attached, stuck tool in position for retrieval by a fishing tool or freeing by a jar.

The apparatus of GB-A-2 303 657 suffers numerous disadvantages.

An important component of the elastically expandable ring is a so-called "resilient ring". This is probably a rubberized or otherwise elastomeric component.

The presence of an elastomeric component renders the disconnect of GB-A-2 303 657 unsuited for use in conjunction with aggressive chemicals (such as acids) that are commonly pumped into oil and gas wells to alter the chemistry of the well fluid and/or surrounding formation.

Also the elastomeric component may be prone to failure over time.

Moreover the elastically expandable ring and safety sleeve occupy a substantial proportion of the cross-sectional area of the central bore of the disconnect device. Consequently these components reduce the maximum flow rate of fluid through the disconnect device.

OBJECTS OF THE INVENTION

It is therefore an object of the invention to provide a reliable, high-strength disconnect device having components that are less susceptible to deterioration and/or chemical attack than that of GB-A-2 303 657.

It is a further object to provide a disconnect device having operative components that have a minimal affect on the dimensions of the central bore of the device.

SUMMARY OF THE INVENTION

In accordance with the invention, the disconnect device includes a mandrel having formed on an outer surface thereof at least one locking formation.

A hollow, female member is provided in which the mandrel is releasably securable. The female member includes at least one lug that is moveably retained relative to an inner surface thereof by a retainer member engaged with at least one retainer formation in the lug.

The lug further includes one or more locking formations that are engageable with a corresponding locking formation on the outer surface of the mandrel to lock the mandrel in the female member when the lug is in a first position relative to the inner surface, and that releases the mandrel from the female member when in a second position relative to the inner surface. A second locking member is provided that is moveable into and out of engagement with the retainer formation of each lug to selectively lock the lug in the first position and release it therefrom to permit its movement to the second position.

The disconnect device may provide that the lug is at least partly received in an aperture in the female member, with a part of the lug protruding into an interior of the female member to permit engagement of the retainer formation thereof with said retainer member.

The retainer formation of the lug may include two parallel retainer grooves formed on opposite sides thereof. The retainer member may include a bifurcated lamina defining juxtaposed edges that are respectively received in the retainer grooves to retain the lug to prevent movement thereof relative to the inner surface of the female member.

A plurality of lugs may be arranged in a circular series about the inner surface of the female member, with the retainer member being generally cylindrical to permit engagement thereof with the retainer formation of each lug.

Each lug may be at least partly received in an ovaloid aperture in the female member with each lug being of complimentary shape to the aperture with which the lug is associated in at least a portion thereof in which the lug is received.

The retainer formation of the lug may include two parallel retainer grooves formed on opposite sides thereof. The locking member may include a bifricated lamina defining juxtaposed edges that are respectively received in the retainer groove to retain each lug in its first position in which the locking formation thereof lockingly engage the locking formations of the mandrel.

A plurality of lugs may be arranged in a circular series about the inner surface of the female member, wherein the locking member is generally cylindrical to permit engagement thereof with the retainer formation of each of the lugs.

A shear pin may be provided for retaining the locking member in engagement with the locking formation of each lug until acted upon by a force sufficient to shear the shear pin.

The mandrel of the disconnect device may be hollow.

A moveable actuator member may extend from one end of the mandrel to protrude beyond another end thereof, with movement of the actuator member in at least a first direction causing movement of the locking member out of engagement with the retainer formation.

A moveable actuator member may extend from one end of the mandrel to protrude beyond another end thereof, with movement of the actuator member in at least a first direction causing movement of the locking member out of engagement with the retainer formation. The actuator member may include a seat for seating thereon of a release member, such seating causing movement of the actuator member.

DESCRIPTION OF THE EMBODIMENTS

Figure 1:
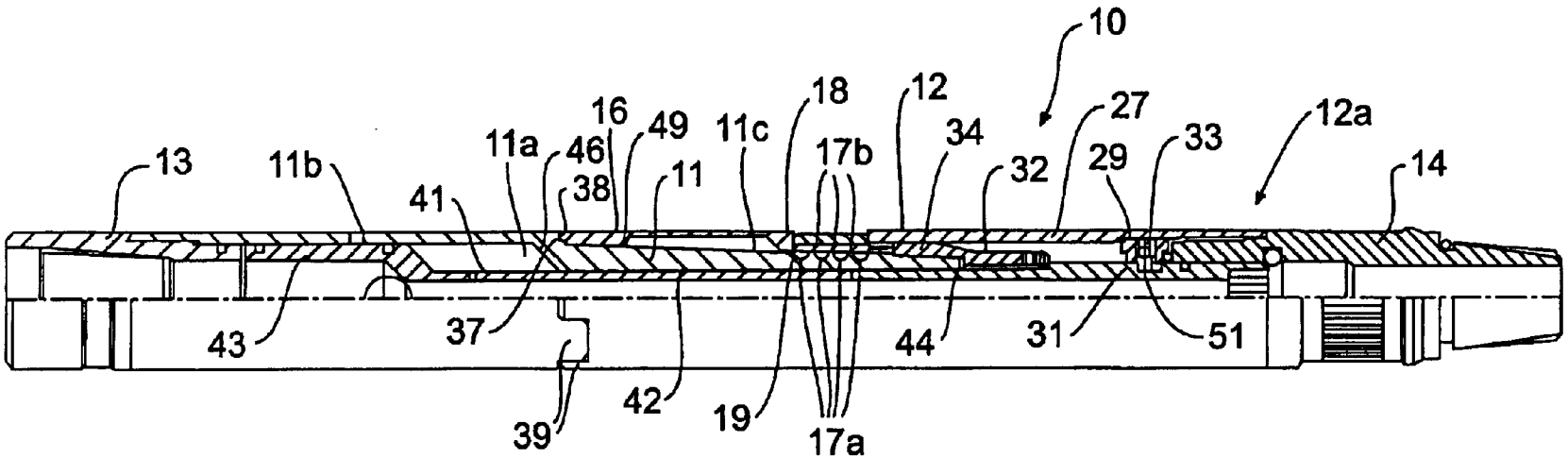
FIG. 1 is a partly transversely sectioned view of a disconnect device according to the invention, with its moveable parts occupying locked positions.

Referring to the drawings a disconnect device 10 comprises a mandrel (male member) 11 and a hollow, cylindrical female member 12, that are normally lockingly secured together, with the male member received within the hollow interior of the female member.

Mandrel 11 includes threadedly secured at its free end remote from member 12 a conventional adapter 13 for attaching mandrel 11 to the downhole end of a tubing string that is not shown in the drawings.

Mandrel 11 is hollow and has formed therein a through-going bore 11*a*, whereby adapter 13 is threadedly received in the open, uphole end 11*b* of the mandrel 11.

Female member 12 is similarly hollow and includes a further, through-going bore.

The downhole end 12*a* of female member 12 includes threadedly received therein a connector 14 by means of which downhole tools and other equipment (omitted from the drawings for clarity) are attachable to the female member.

Uphole end 11*b* of mandrel 11 is cylindrical. Downhole of cylindrical portion 11*b* mandrel 11 includes a tapered section 11*c*.

Cylindrical section 11*b* is of the same diameter as the cylindrical body 16 of female member 12, whereby tapered portion 11*c* defines a mandrel portion that is receivable within the female member 12.

Adjacent its downhole end, the tapered portion 11*c* has formed on its outer surface a series of annular grooves 17 and ridges 20 whose purpose is described in more detail herein below.

The cylindrical body 16 of female member 12 is perforated at a series of locations 18 defining an annular pattern.

In the preferred embodiment shown, there are three ovaloid perforations 18 spaced apart from another at 120° intervals about the cylindrical body 16.

In other embodiments of the invention, different numbers and/or patterns of the perforations are possible. Also it is possible to vary the shapes of the perforations. Nonetheless the ovaloid perforations are particularly effective, for reasons given hereinabove.

Each perforation 18 has moveably retained therein, by means described below, a respective lug 19.

Figure 2A:
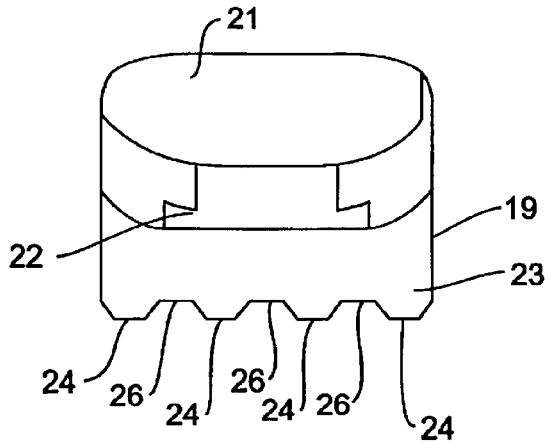
FIGS. 2A–2C are perspective views of lugs forming part of the FIG. 1 device.
Figure 2B:
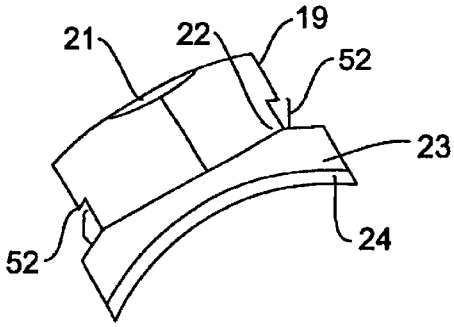
Figure 2C:
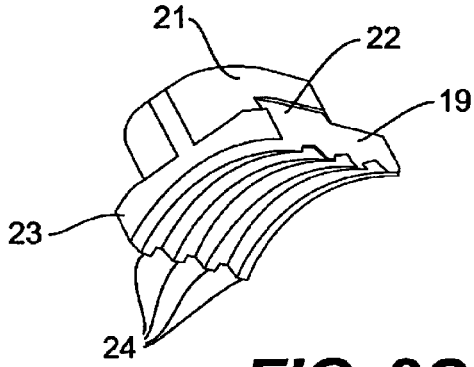

At best shown in FIGS. 2A–2C, which illustrate the lugs 19 before assembly into the device 10, each lug 19 includes an ovaloid portion 21 that on assembly of the disconnect device 10 is radially outermost and is received as a snug, sliding fit in a said perforation 18.

Disposed radially inwardly of ovaloid portion 21 is a continuous web 22 rigidly connecting the ovaloid portion to an essentially laminar, curved locking portion 23.

Each locking portion 23 includes formed on its radially innermost face a series of ridges 24 and grooves 26 of complementary profile, number and dimensions to the ridges 20 and grooves 17 defined in the outer surface of tapered portion 11*c* of mandrel 11.

In use the locking formations defined by the ridges 24 and grooves 26 of the locking portions are engageable with the corresponding locking formations defined by the grooves 17 and ridges 20 in the mandrel.

Figure 3A:
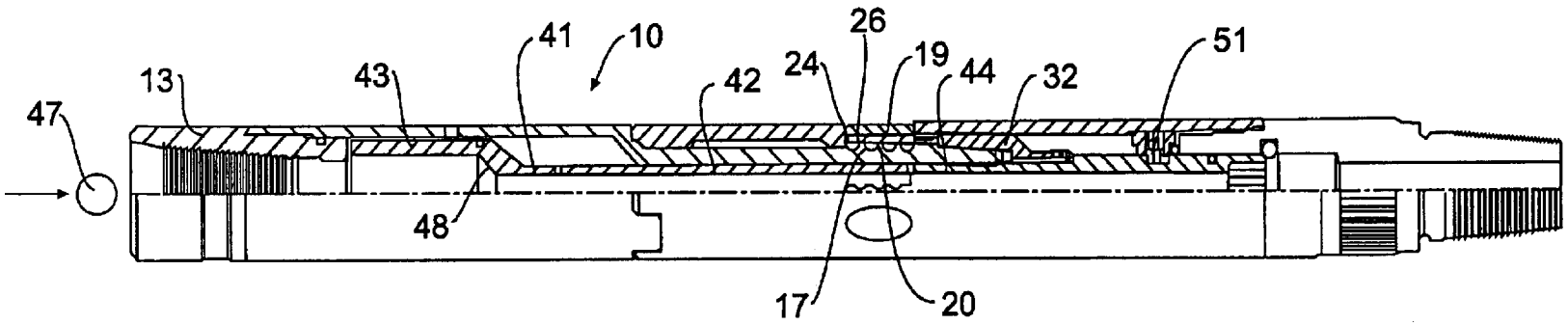
FIGS. 3A–3D are perspective, partly sectioned views showing steps in the releasing of the device of the invention, from the condition shown in FIG. 1.

This effect arises when the lugs adopt the first, locking position shown in FIGS. 1 and 3A.

Figure 3B:
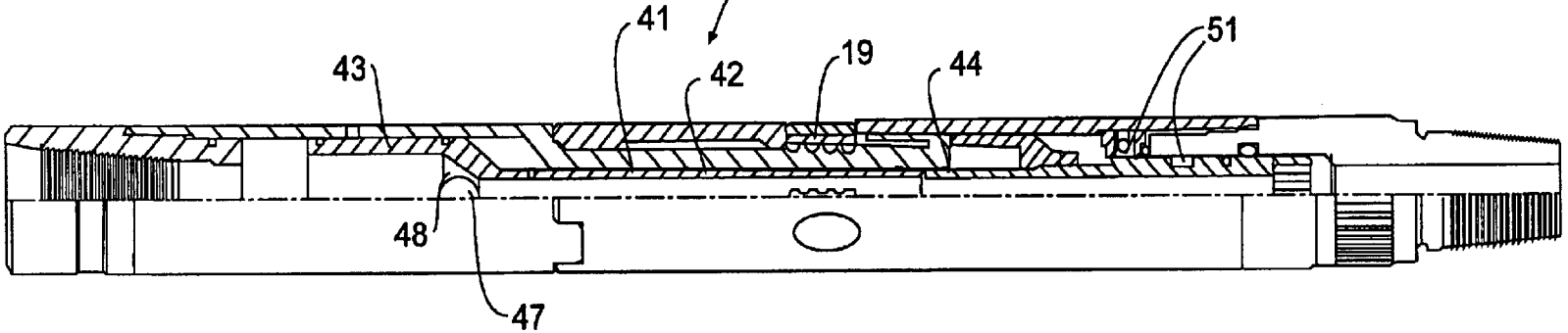
Figure 3C:
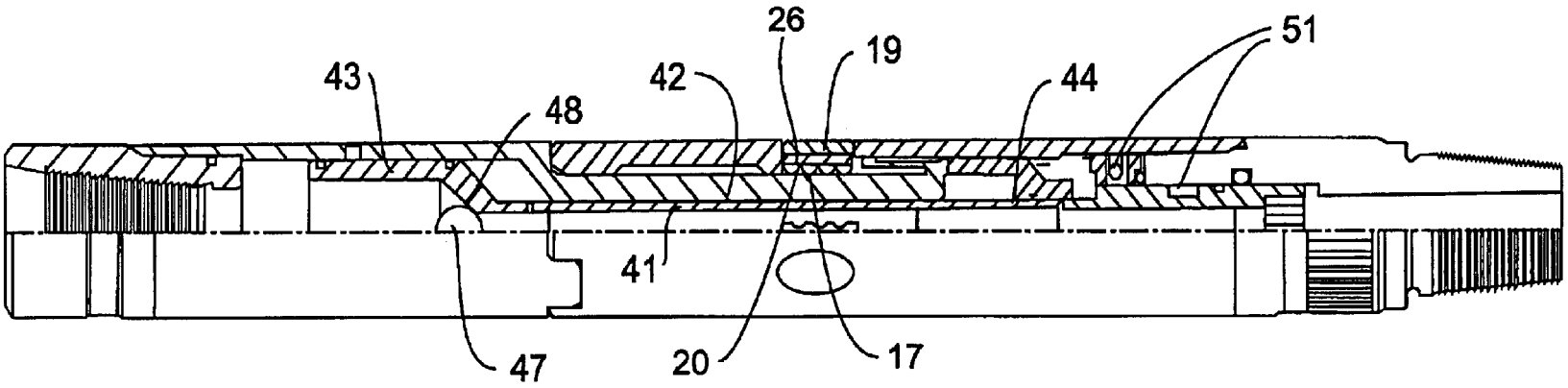
Figure 3D:
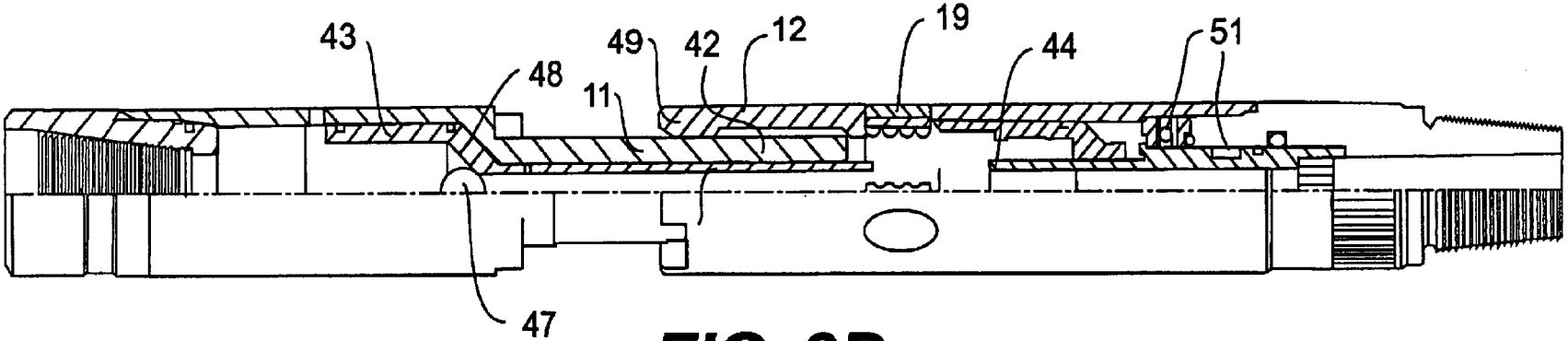

On operation of the device 10 to cause disconnection of the male and female parts from one another the lugs move to a second, unlocking position as shown in FIGS. 3C and 3D and described in more detail below, in which the respective ridges and grooves 17, 20, 24 and 26 are no longer lockingly engaged with one another.

Figure 4:
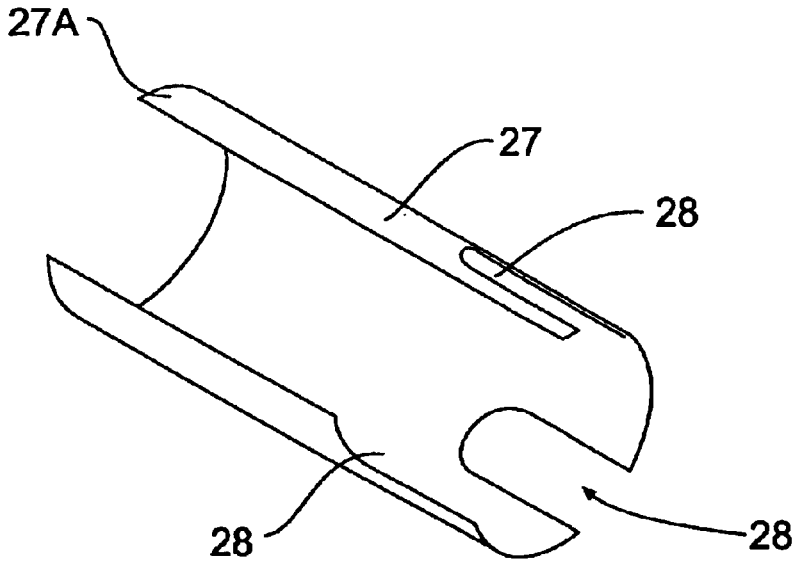
FIG. 4 shows in perspective view a cylindrical retainer member that forms part of the device of the invention.

Each lug is retained moveably captive in its associated perforation 18 by way of a retainer member 27. FIG. 4 shows the retainer member 27 partly cut away, and isolated from the other components of device 10. In practice member 27 would define a complete, hollow cylinder.

The thickness of the cylindrical wall of retainer member 27 is less than the depth of the groove 52 defined on each side of each lug, beneath the ovaloid portion 21, by the web 22.

At one end retainer member 27 is bifurcated at three locations to define an annular series of slots 28 extending from the open end of the cylinder towards the center thereof. (In FIG. 4 one of the slots is incomplete by reason of the sectional view shown. In practice all the slots would be complete.)

The slots 28 correspond in width and angular spacing to the dimensions and locations of the webs 22 of the lugs 19, when the latter are received in the perforations 18.

Consequently when the retainer member 27 is located as shown in FIGS. 1 to 3, engagement of the slots 28 to either side of the webs 22 causes retention of the lugs 19 in the perforations 18.

Since the wall thickness of retainer member 27 is less than the depth of each groove 52, the lugs 19 are held loosely captive by the retainer member 27. In other words, the action of retainer member 27 alone is to permit limited movement of the lugs radially inwardly and outwardly relative to the cylindrical wall of female member 12.

The end 27*a* of retainer member 27 remote from the lugs 19 engages a collar 29 whose functions are described in more detail herein below.

Collar 29 is fixed to the cylindrical wall of female member 12, by reason of being reacted by tool connector 14. Consequently retainer member 27 is retained in a constant axial location in the female member, regardless of the locked/unlocked status of the disconnect device 10.

Collar 29 includes a central, through bore in which is slidingly located a hollow, cylindrical shank 31 forming part of a locking member 32. Shank 31 is secured to collar 32 by means of one or more shear pins 51, or (in the preferred embodiment) shear screws protruding through apertures 33 extending radially through collar 29 as shown. Shank 32 includes an annular series of recesses 53 (FIG. 5) formed in its outer surface, for receiving the ends of the shear screws.

In practice in the preferred embodiment collar 29 is perforated at a series of locations about its periphery, whereby the user of the disconnect may select the number of shear screws inserted. This in turn allows adjustment of the shear threshold of the device.

Figure 5:
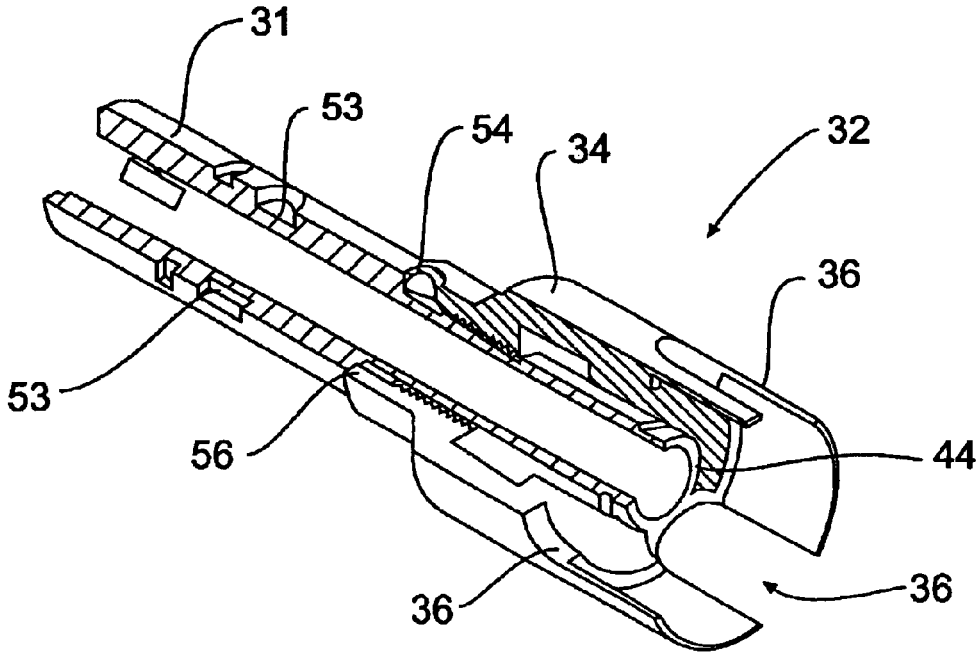
FIG. 5 shows in perspective view a locking member assembly that also forms part of the device.

As shown in FIG. 5, uphole of shank 31 locking member 32 enlarges to define at its free, uphole end a hollow, open-ended cylindrical portion 34. Cylindrical portion 34 is threadedly received on shank 31 and retained in position by locking screws (not shown in the drawings) passing through one or more threaded, radial bores 54. A shoulder 56 limits the extent to which portion 34 is screwed onto shank 31.

The diameter of cylindrical portion 34 is such that it is a sliding fit within the hollow interior of retainer member 27.

Cylindrical portion 34 includes formed therein a series of slots 36 of essentially the same dimensions and angular spacings as the slots 28 formed in the end of retainer member 27. Consequently the slots 36 are engageable in the grooves 52 formed in the lugs 19, in the same manner as the slots 28.

When so engaged, the combined wall thickness of the retainer member 27 and the cylindrical portion 34 of locking member 32 is substantially the same as the depth of each groove 52. Consequently the lugs 19 are urged inwardly relative to the walls of female member 12, such that the grooves and ridges 17, 20 lockingly engage the grooves and ridges 24, 26.

Such inward urging of the lugs 19 is however limited by reason of the ovaloid portions 21 and the locking portions 23 of the lugs 19 being wider than the webs 22 when measured in the circumferential direction of the female member 12.

Figure 6:
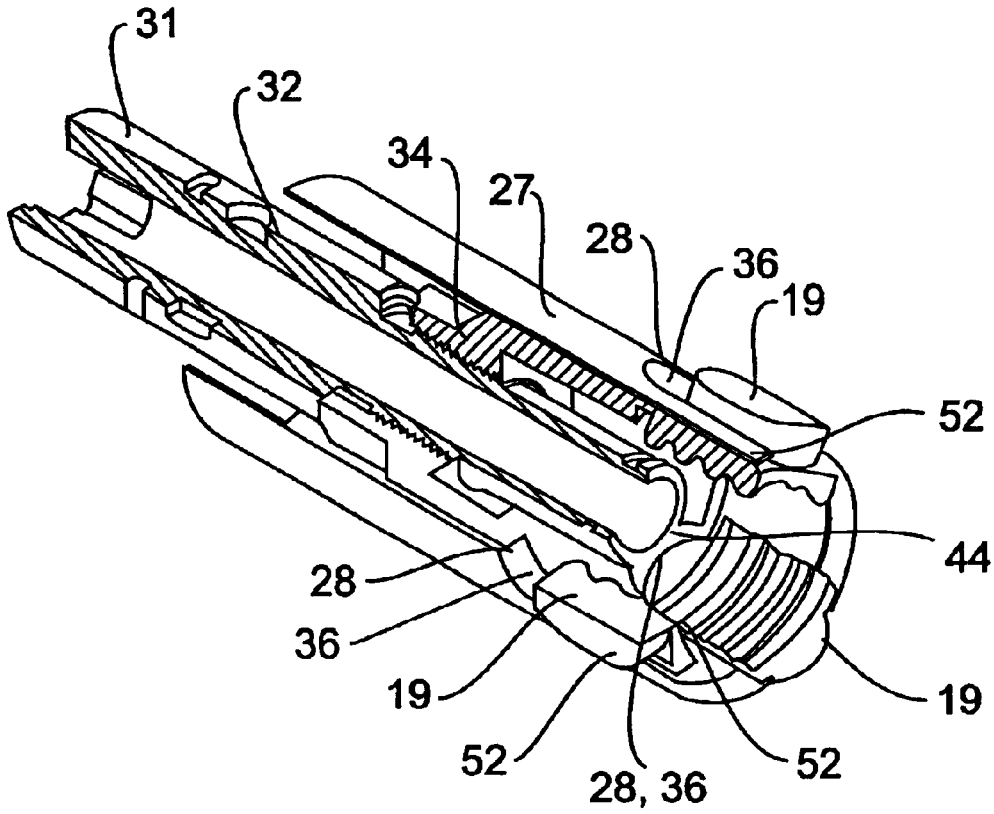
FIG. 6 shows in a partly cut-away view how the components of FIGS. 4 and 5 coact with further parts of the device.

This arrangement of the retainer member 27, locking member 32 and the lugs 19 is shown in FIG. 6, from which the other parts of device 10 have been omitted for clarity.

The locking member 32 is normally retained in the position, shown in FIGS. 1 and 3A, with its slots 36 engaging the grooves 52, by reason of the shear pins or screws 51.

When thus configured, the disconnect device rigidly locks the male and female components together.

The mandrel 11 includes an actuator 41 received within its hollow interior.

Actuator 41 includes a hollow, cylindrical shank 42 at its downhole end.

At its uphole end the diameter of actuator 41 enlarges to define a hollow seating cup 43 that is a snug, sliding fit within the interior of mandrel 11.

Shank 42 extends downwardly and, in the assembled condition of the disconnect device terminates in contact with a spigot 44 protruding upwardly within locking member 32 that is a continuation of shank 31.

Shank 42, spigot 44 and shank 31 define between them a conduit extending along the length of the disconnect device 10. Thus fluid flow along the interior of the device 10 is possible.

Actuator 41 is moveable longitudinally within mandrel 11. The limits of movement of the mandrel are defined respectively by the adapter 13 at the upper end of the device 10, and an internal shoulder 46 at the downhole end.

At their engaging surfaces 37 and 38 (the former of which is defined part-way along the mandrel 11, at the location where the cylindrical portion 11*a* merges into the tapered portion 11*b*) the mandrel 11 and the female member 12 respectively are formed with inter-engageable castellations 39 that prevent rotation of the male and female components relative to one another.

In use of the disconnect device, the components are assembled as shown in FIGS. 1 and 3A. Thus the mandrel 11 and the female member 12 are firmly locked together. The disconnect device is then added at a desired location in a tubing string.

Before such incorporation of the device 10 into a tubing string, or at least prior to deployment of the device 10 to a downhole location, an operator can readily check that the device 10 is in its locked configuration.

This can be by visual inspection of the lugs 19 via the perforations 18: if the lugs 19 are held recessed relative to the outer surface of cylindrical body 16 the device 10 is in its locked configuration. If on the other hand the lugs 19 are loose and/or flush with the outer surface, the device is not correctly set to its locked (pre-use) condition.

The user can, alternatively or additionally to the visual inspection, assess the locking state of device 10 by feeling with his hand the positions of the lugs 19. This facility may be beneficial when the device is obscured from view, such as by reason of being immersed in an opaque liquid.

The visual and physical checks described above can all be effected without separating the male and female parts of device 10 from one another.

During normal working of the well, drilling and/or other fluid is circulated via the tubing string, including the path defined by the shank 42, spigot 44 and shank 31. At such times, the mandrel 11 and female member 12 are firmly, anti-rotatively locked together by reason of the above described components.

The unlocking sequence of the device 10 is now described with reference to FIGS. 3A–3D.

When it is necessary to cause disconnection of the device 10, a drop ball 47 is pumped down the coil tubing to enter the disconnect device 10 via the open end of the adapter 13.

The drop ball seats in an internal seat 48 in seating cup 43 of actuator 41 (FIG. 3B).

This blocks the flow of fluid through the disconnect device so that the full pumping pressure in the CT acts via the drop ball 47 and seating cup 43 on shank 42.

Since the downhole end of shank 42 is in contact with spigot 44, the aforesaid pressure acts downwardly on the locking member 32, against the resistive force provided by the shear screws 51.

Assuming the shear threshold of the screws 51 has been correctly chosen and/or the number of screws correctly selected, this pressure will be sufficient to shear the shear screws (FIG. 3B).

Consequently the actuator 41 moves downwardly in the male member, driving the locking member 32 downwardly as well (FIG. 3B).

This causes the slots 36 to move out of engagement with the grooves 52 defined in the lugs 19. Consequently the lugs 19 become free to move to a limited extent radially outwardly, the extent of movement of the lugs being determined by the relative thickness of the grooves 52 and the wall of retainer member 27 in the vicinity of slots 28 (FIG. 3C). This in turn releases the groove and ridge combinations 17, 20, 24, 26 from engagement with one another, whereby it is possible to withdraw the mandrel from the female member typically by coiling the CT onto its drum at a surface location (FIG. 3D).

Following such an operation the female member 12 and any tooling secured thereto at a downhole location remains in the well.

The female member includes formed therein a conventional internal fishing neck 49 that is engageable as desired by a fishing tool for the purpose of retrieving stuck tooling following disconnection of the device 10.

What is claimed is:

1. A disconnect device comprising, a mandrel having formed on an outer surface thereof at least one locking formation;

a hollow, female member in which the mandrel is releasably securable, the female member including at least one lug that is moveably retained relative to an inner surface thereof by a retainer member engaged with at least one retainer formation formed in said lug;

said lug further including one or more locking formations that are engageable with a corresponding said locking formation on the outer surface of the mandrel to lock the mandrel in the female member when said lug is in a first position relative to said inner surface, and that release the mandrel from the female member when in a second position relative to said inner surface; and a second locking member that is moveable into and out of engagement with said retainer formation of said lug to selectively lock said lug in the said first position and release it therefrom to permit its movement to the said second position.

2. A disconnect device according to claim 1, wherein said lug is partly received in an aperture in said female member, with a part of said lug protruding into an interior of said female member to permit engagement of said retainer formation thereof with said retainer member.

3. A disconnect device according to claim 1, wherein said retainer formation of said lug includes two parallel retainer grooves formed on opposite sides thereof; and the retainer member includes a bifurcated lamina defining juxtaposed edges that are respectively received in said retainer grooves to retain said lug to prevent movement thereof relative to said inner surface of said female member.

4. A disconnect device according to claim 1, wherein a plurality of said lugs is arranged in a circular series about said inner surface of said female member; and wherein said retainer member is generally cylindrical to permit engagement thereof with said retainer formation of each of said plurality of lugs.

5. A disconnect device according to claim 1, wherein each said lug is at least partly received in an ovaloid aperture in said female member; and each said lug is of complementary shape to said aperture with which said lug is associated at least in a portion thereof in which said lug is received.

6. A disconnect device according to claim 1, wherein said retainer formation of said at least one lug includes two parallel retainer grooves formed on opposite sides thereof; and wherein said locking member includes a bifurcated lamina defining juxtaposed edges that are respectively received in said retainer grooves to retain said lug in its first position in which said locking formations thereof lockingly engage said locking formations of said mandrel.

7. A disconnect device according to claim 1, wherein a plurality of said lugs is arranged in a circular series about said inner surface of said female member; and wherein said locking member is generally cylindrical to permit engagement thereof with said retainer formation of each of said plurality of lugs.

8. A disconnect device according to claim 1, wherein a shear pin is provided for retaining said locking member in engagement with said retainer formation of each said lug until acted on by a force sufficient to shear said shear pin.

9. A disconnect device according to claim 1, wherein said mandrel is hollow.

10. A disconnect device according to claim 1, wherein a moveable actuator member extends from one end of said mandrel to protrude beyond another end thereof, with movement of said actuator member in at least a first direction causing movement of said locking member out of engagement with said retainer formation.

11. A disconnect device according to claim 1, wherein a moveable actuator member extends from one end of said mandrel to protrude beyond another end thereof, with movement of said actuator member in at least a first direction causing movement of said locking member out of engagement with said retainer formation, the actuator member including a seat for seating thereon of a release member, such seating causing said movement of said actuator member.

* * * * *